US008432421B2

(12) United States Patent
Muraki et al.

(10) Patent No.: US 8,432,421 B2
(45) Date of Patent: Apr. 30, 2013

(54) THERMAL PRINT HEAD, THERMAL PRINTER AND PRINTER SYSTEM

(75) Inventors: Kaoru Muraki, Kyoto (JP); Masatoshi Nakanishi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 390 days.

(21) Appl. No.: 12/841,658

(22) Filed: Jul. 22, 2010

(65) Prior Publication Data

US 2011/0018951 A1 Jan. 27, 2011

(30) Foreign Application Priority Data

Jul. 24, 2009 (JP) ..... 2009-172729
Jun. 21, 2010 (JP) ..... 2010-140688

(51) Int. Cl.
*B41J 2/355* (2006.01)

(52) U.S. Cl.
USPC ..... 347/209

(58) Field of Classification Search ..... 347/209, 347/210, 211
See application file for complete search history.

(56) References Cited

U.S. PATENT DOCUMENTS

2009/0073250 A1* 3/2009 Nakanishi et al. ..... 347/211

FOREIGN PATENT DOCUMENTS

| | | |
|---|---|---|
| JP | 62-278860 | * 11/1988 |
| JP | 2000-246944 | 9/2000 |
| JP | 2003-132330 | 5/2003 |
| JP | 2005-186302 | 7/2005 |

* cited by examiner

*Primary Examiner* — Huan Tran
(74) *Attorney, Agent, or Firm* — Hamre, Schumann, Mueller & Larson, P.C.

(57) ABSTRACT

A thermal print head includes a heating resistor for forming images on a print target by generating heat, and a driver for controlling power supply to the heating resistor. The thermal print head also includes a storage unit and a controller. The storage unit stores print data inputted from outside. The controller causes a transfer action and a printing action to be repeated alternately, wherein the transfer action includes retrieving print data from the storage unit and transferring the retrieved print data to the driver, and the printing action includes causing the driver to retain the transferred print data and supplying power to portions of the heating resistor selected in accordance with the print data retained by the driver, so as to conduct printing.

23 Claims, 16 Drawing Sheets

THERMAL PRINT HEAD, THERMAL PRINTER AND PRINTER SYSTEM

BACKGROUND OF THE INVENTION

1. Field of the Invention

The present invention relates to a thermal print head, a thermal printer including the thermal print head, and a printer system including a plurality of thermal printers.

2. Related Art

There has been known a thermal print head or a thermal printer incorporating a thermal print head (see JP-A-No. 2005-186302, for example) that causes the heating resistor to selectively heat recording paper (such as thermosensitive paper) or thermal transfer ink ribbon, so that letters or images are to be printed.

FIG. 16 is a block diagram of an example of the thermal printer including the conventional thermal print head. The thermal printer 990 shown therein includes the thermal print head 999. The thermal print head 999 includes a substrate 991, a heating resistor 992, a driver IC 993, and a connector 994. On the substrate 991, an elongated heating resistor 992 is provided. The thermal print head 999 is connected to a control unit 995 of the thermal printer 990, via the connector 994.

To the thermal print head 999, a printing data signal, control signal, and power necessary for executing a printing action are transmitted from the control unit 995 through the connector 994. The printing data signal and the control signal are transferred to the driver IC 993 through a wiring pattern 996 formed on the substrate 991.

The control signal includes a clock signal, a latch signal and a strobe signal. The clock signal serves to establish synchronization when data to be printed is outputted to the driver IC 993. The latch signal serves to output in parallel the printing data signal serially inputted, by an amount corresponding to one line of the image. The strobe signal serves for supplying power to the heating resistor 992. Here, a printing mechanism such as a platen roller for activating the printing action is not shown in the thermal printer 990 shown in FIG. 16.

The thermal print head 999 is capable of producing a smooth printing action in the case of printing letters and characters containing relatively small data amount. On the other hand, in the case where the data to be printed is, for example, image data that contains gradations of light and intense of black color, the thermal print head 999 executes the following process.

To print the data corresponding to one line for example, the data is outputted to the driver IC 993 the times corresponding to the number of gradations of the image. When the number of gradations is 256 for example, the data for 255 times of printing per line (except for the gradation "0 (=white)") is transferred from the control unit 995 to the thermal print head 999. To be more detailed, the image data containing the data representing the dots of the gradation "1" and higher is inputted to a shift register (not shown) in the driver IC 993, at a first transfer. Then the image data inputted to the shift register is retained by the latch signal. Then power is supplied according to the strobe signal to the portion of the heating resistor 992 to be heated, determined based on the image data, so that such portion is heated. Thus, the data corresponding to the dots of the gradation "1" and higher is printed on the recording paper.

Then the image data corresponding to the dots of the gradation "2" and higher is transferred, and the similar process is executed. In this case, the dots of the gradation "2" and higher are printed over the dots of the gradation "1", which have been printed in the first printing process. Such data transfer is executed up to the image data corresponding to the dots of the gradation "255 (=black)". The transfer action of the image data and the printing action on the recording paper are repeated 255 times respectively. With respect to the dots of the gradation "0 (=white)", such printing process is not executed. The region on the recording paper corresponding to the dots that have remained unprinted during the printing process from the gradation "1" to the gradation "255" resultantly represents the white portion corresponding to the gradation "0".

Thus, the thermal printer 990 including the thermal print head 999 has to repeat the transfer action of the image data and the printing action, for printing the image data containing the gradations. This leads to the drawback that the printing takes a long time.

It might be possible to increase the transfer rate of the image data between the control unit 995 of the thermal printer 990 and the thermal print head 999, in order to print the image data at a higher speed. However, an excessively high transfer rate may provoke deformation of the waveform of the signals on respective signal lines between the control unit 995 of the thermal printer 990 and the thermal print head 999, resulting in data deficiency. Besides, radiation may take place in the respective signal lines, which may disturb normal transfer of the signals between each other. Accordingly, a limitation is inevitably imposed on the transfer rate of the image data between the control unit 995 of the thermal printer 990 and the thermal print head 999, and hence it is difficult to transfer the image data at a higher speed. Especially in the case of printing the image data containing an enormous data amount, the printing speed of the thermal print head 999 is subjected to such limitation. Also, the deformation of the waveform and the radiation appear more prominently, as the line length between the control unit 995 of the thermal printer 990 and the thermal print head 999 becomes longer. Therefore, the line length is also limited.

Meanwhile, recently an automatic identification system has come to be widely employed, for example for luggage management at an airport. The automatic identification system automatically takes up the data of the objects to be managed, by means including both hardware and software without depending on human power, and recognizes the data of the object. Specific examples of the automatic identification system include the one that utilizes a Radio Frequency IDentification (RFID) tag. The RFID tag includes a memory for recording the identification data, and a medium-side coil antenna for data transmission/reception by wireless communication, and letters or a barcode representing the identification data is printed on the outer surface of the RFID tag. To execute the data transmission/reception to and from the RFID tag, and the printing thereon, for example an RFID tag printer is employed (for example, JP-A No. 2003-132330).

However, the RFID tag printer has to be equipped with the antenna for data transmission/reception and a driver IC therefor, in addition to the thermal print head engaged in the printing function. Especially in the case where the antenna is located distant from the RFID tag, the print target, the reliability of the data transmission/reception may be degraded.

SUMMARY OF THE INVENTION

The present invention has been proposed under the foregoing situation, with an object to provide a thermal print head capable of printing image data at a high speed even when, for example, the image data contains gradations, a thermal printer including such thermal print head, and a printer system.

Another object of the present invention is to provide a thermal print head and a thermal printer with a wireless communication function, that can be made smaller in dimensions and that can improve reliability and speed of data transmission/reception.

A first aspect of the present invention provides a thermal print head comprising: a heating resistor that generates heat for forming an image on a print target; a driver that controls power supply to the heating resistor; a storage unit that stores print data inputted from outside; and a main controller that causes a transfer action and a printing action to be alternately repeated, where the transfer action includes retrieving print data from the storage unit and transferring the retrieved print data to the driver, and the printing action includes causing the driver to retain the transferred print data and supplying power to portions of the heating resistor selected in accordance with the print data retained by the driver, so as to conduct printing.

In a preferred embodiment of the present invention, the thermal print head comprises: a substrate on which the heating resistor is formed; and an intermediate conductor mounted on the substrate, where the controller comprises a control chip removably supported by the intermediate conductor.

In a preferred embodiment of the present invention, the substrate is provided with a wiring pattern including a signal line for the print data disposed between the control chip and the driver. The wiring pattern further includes a signal line for a control signal to supply power to the heating resistor.

In a preferred embodiment of the present invention, the substrate is connected with a signal line for transferring a signal to be inputted to the control chip, where the signal line is an I2C signal line for executing serial transfer of the signal.

In a preferred embodiment of the present invention, the thermal print head further comprises an additional intermediate conductor mounted on the substrate, where the storage unit comprises a memory chip removably supported by the additional intermediate conductor.

In a preferred embodiment of the present invention, the thermal print head further comprises a data transmitter/receiver that executes data transmission/reception by wireless communication with respect to the print target, where the print target is provided with a target-side coil antenna and a memory.

In a preferred embodiment of the present invention, the data transmitter/receiver includes an apparatus-side coil antenna.

In a preferred embodiment of the present invention, the data transmitter/receiver further includes a driver IC for the apparatus-side coil antenna.

In a preferred embodiment of the present invention, the data transmitter/receiver is capable of executing data transmission/reception to and from the print target, which is constituted as a Radio Frequency IDentification (RFID) tag.

In a preferred embodiment of the present invention, the thermal print head further comprises a substrate, and a plurality of heating resistors aligned on the substrate, where the apparatus-side coil antenna is mounted on the substrate.

In a preferred embodiment of the present invention, the apparatus-side coil antenna is located on a face of the substrate on which the plurality of heating resistors are provided.

In a preferred embodiment of the present invention, the thermal print head further comprises a magnetic sheet containing a magnetic material.

In a preferred embodiment of the present invention, the magnetic material is ferrite.

In a preferred embodiment of the present invention, the magnetic sheet is located on a face of the substrate opposite to a face on which the apparatus-side coil antenna is provided.

In a preferred embodiment of the present invention, the thermal print head further comprises a cover that covers the driver IC, where the cover is formed with an opening through which the apparatus-side coil antenna is exposed as viewed in a thicknesswise direction of the substrate.

In a preferred embodiment of the present invention, in a main scanning direction, the opening is smaller in size than the print target.

A second aspect of the present invention provides a thermal printer with a wireless communication function. This thermal printer comprises the thermal print head according to the first aspect of the present invention, so that both printing on the print target and data transmission/reception to and from the print target can be executed.

A third aspect of the present invention provides a thermal printer comprising: the thermal print head according to the first aspect of the present invention; an action controller that transmits the print data to the thermal print head and causes the thermal print head to execute printing; and a signal line for serially transferring the print data from the action controller to the main controller.

The fourth aspect of the present invention provides a printer system comprising: a plurality of thermal printers each including the thermal print head according to the first aspect of the present invention; a control unit that transmits the print data to a designated thermal printer among the plurality of thermal printers and causes the designated thermal printer to execute printing; and a signal line that connects the control unit and the plurality of thermal printers in a bus configuration, for serial transfer of the print data.

Other features and advantages of the present invention will become more apparent through the detailed description given hereunder referring to the accompanying drawings.

DETAILED DESCRIPTION OF THE PREFERRED EMBODIMENTS

Figure 1:
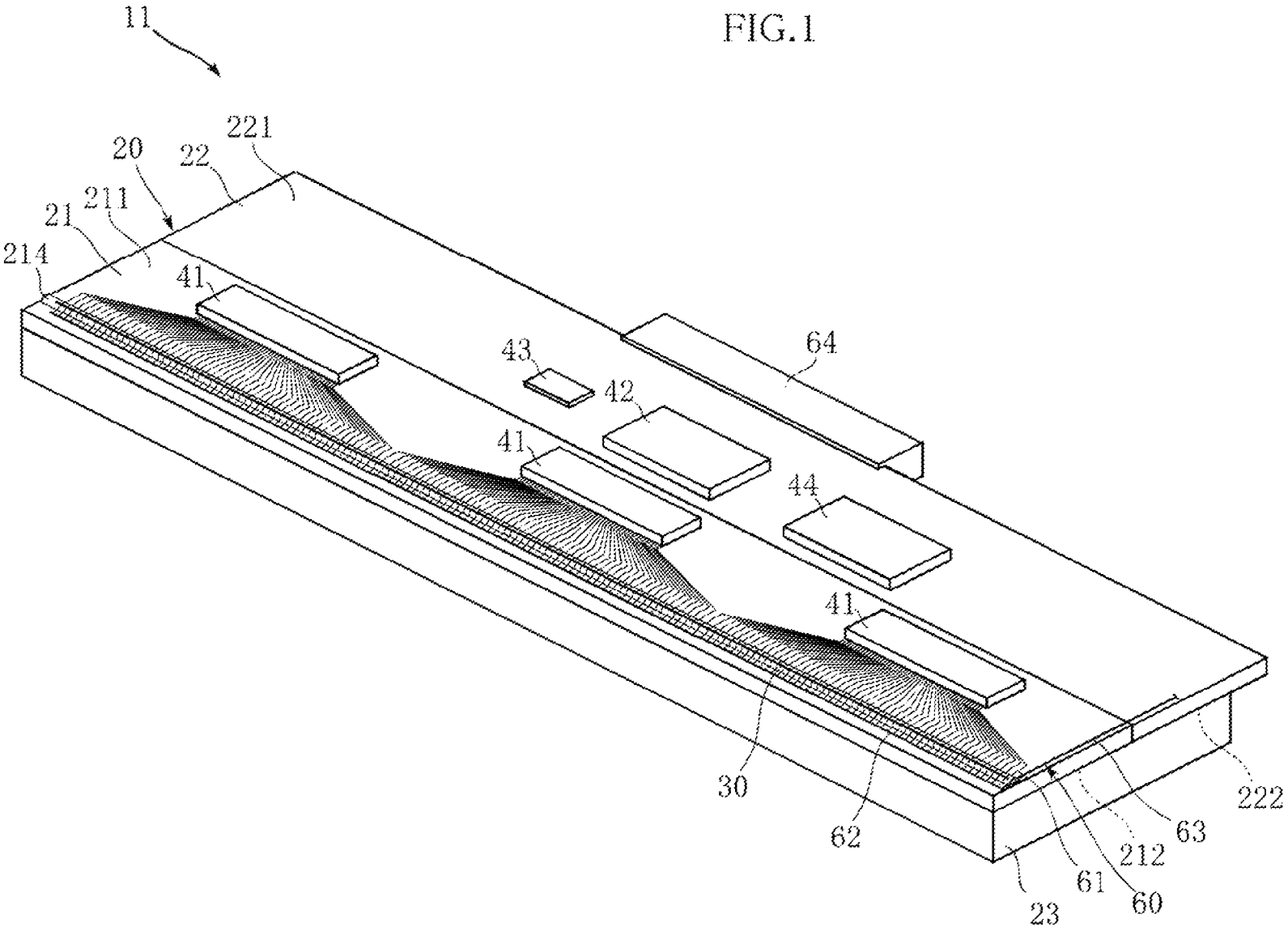
FIG. 1 is a perspective view showing a thermal print head according to a first embodiment of the present invention.
Figure 2:
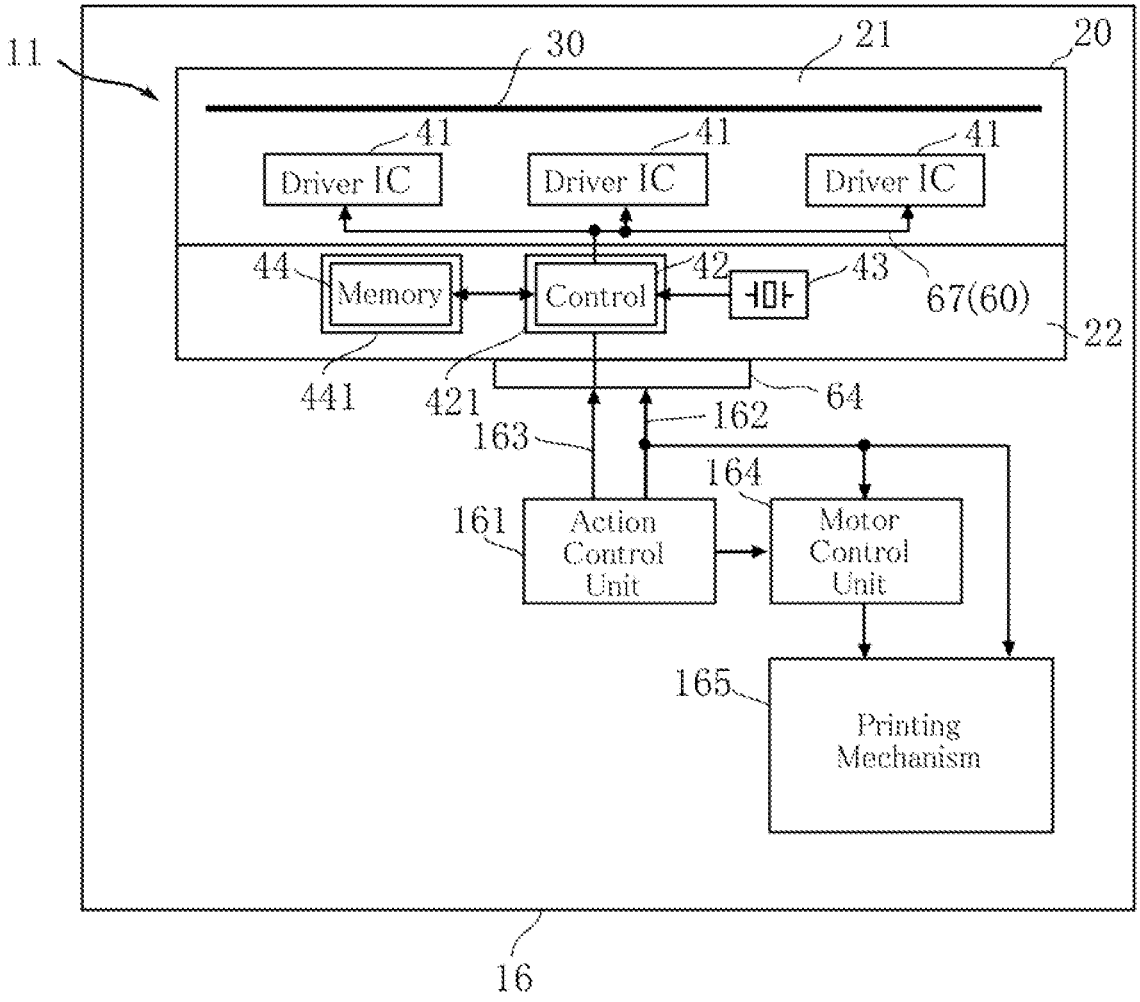
FIG. 2 is a block diagram of a thermal printer including the thermal print head according to the first embodiment of the present invention.

FIG. 1 depicts a thermal print head according to a first embodiment of the present invention, and FIG. 2 is a block diagram of a thermal printer including the thermal print head. The thermal print head 11 and the thermal printer 16 are configured to print letters and images on recording paper such as thermosensitive paper or other kinds of recording medium ("print target"). The thermal print head 11 according to this embodiment includes a substrate 20, a heat dissipater 23, a heating resistor 30, a driver IC 41, a control chip 42, a quartz oscillator 43, a memory chip 44 and a connector 64.

The substrate 20 serves as the case of the thermal print head 11, and is constituted of a heating function unit 21 and a circuit board 22 in this embodiment. Unlike this embodiment, the substrate 20 may be constituted of a single material.

The heating function unit 21 is made of an insulating material such as a ceramic, and formed in a rectangular shape, for example. On a front face 211 of the heating function unit 21, the heating resistor 30 and the driver IC 41 are mounted. In a region close to an edge of a side of the front face 211, a partial glaze 214 is provided. The partial glaze 214 extends in a main scanning direction, and protrudes in a direction of the normal of the front face 211.

The circuit board 22 is a printed circuit board constituted of, for example, a glass epoxy resin. On a front face 221 of the circuit board 22, the control chip 42, the quartz oscillator 43, and the memory chip 44 are mounted.

Figure 4:
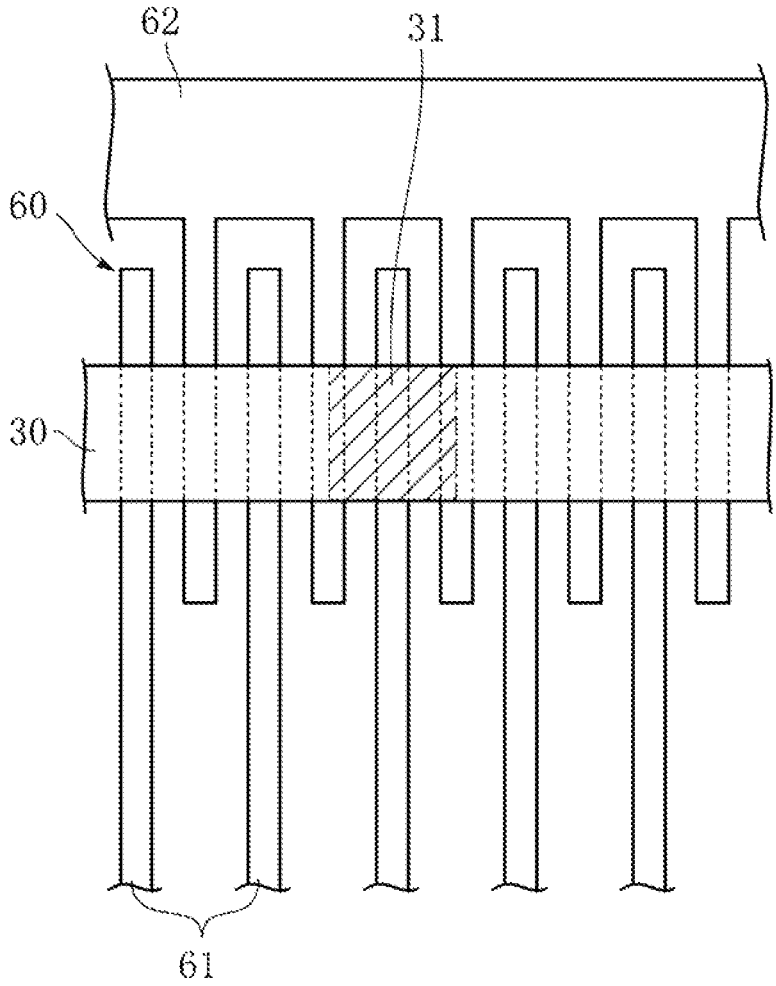
FIG. 4 is a fragmentary plan view of a heating resistor of the thermal print head according to the first embodiment of the present invention.

On the front face 211 of the heating function unit 21 and the front face 221 of the circuit board 22, wiring 60 is provided. The wiring 60 includes a plurality of individual electrodes 61, a common electrode 62, a common line 63, and a signal line 67. As shown in FIG. 4, the common electrode 62 is constituted of an elongated strip-shaped portion extending in the main scanning direction and a plurality of branch portions extending in a comb teeth shape in a sub scanning direction. The individual electrodes 61 have the respective tip portion alternately aligned with respect to the branch portions, in the main scanning direction. As shown in FIG. 1 the common line 63 is connected to the common electrode 62, and extends to the connector 64. The individual electrodes 61, the common electrode 62, and the common line 63 may be formed, for example, by thick film printing of a resinate Au paste, followed by sintering.

The heat dissipater 23 is a thick rectangular plate, for example made of aluminum. As shown in FIG. 1, the heat dissipater 23 is stuck to a back face 212 of the heating function unit 21 and a back face 222 of the circuit board 22.

The heating resistor 30 is made of a resistance material such as ruthenium oxide, and provided in a strip-shape on the partial glaze 214. As shown in FIG. 4, the heating resistor 30 is located so as to run over the branch portions of the common electrode 62 and the tip portion of the individual electrodes 61. When a current runs between the common electrode 62 and one of the individual electrodes 61, the heating resistor 30 is partially heated in a region defined by the branch portions and the tip portion. Such region will be referred to as a heating portion 31. The heating resistor 30 constitutes a plurality of heating portions 31 aligned in the main scanning direction. The heating resistor 30 may be formed, for example, by thick film printing of a ruthenium oxide paste, followed by sintering. Also, the heating resistor 30 is covered with a cover layer (not shown), for example made of glass.

The driver IC 41 serves to selectively supply power to the heating resistor 30 through the individual electrodes 61. To the driver IC 41, printing data signals and control signals necessary for a printing action is inputted from the control chip 42. The control signal includes a clock signal, a latch signal, and a strobe signal.

The control chip 42 is constituted of a CPU, and capable of converting image data inputted via the connector 64 into gradation pattern data, and storing the converted gradation pattern data in the memory chip 44. Here, the image data consists, for example, of a group of numerals representing the gradation of each dot. On the other hand, the gradation pattern data consists of numeric columns each having equivalent values to the number of dots per line, and the number of such columns is equivalent to the number of printing times corresponding to a maximal number of gradations. In the respective numeric column, the numeral corresponding to a dot to be printed is 1, and the numeral corresponding to a dot not to be printed is 0, for each printing action. In this embodiment, the control chip 42 is located adjacent to the memory chip 44. Such configuration allows shortening the path for the data transfer.

In this embodiment, the gradation pattern data is subjected to what is known as thermal history control. The thermal history control serves to control the energy to be supplied to a minute portion of the heating resistor 30, taking into account the immediately precedent thermal history and influence of an adjacent minute portion of the heating resistor 30 that has been heated. The process of the thermal history control is executed by the control chip 42.

The control chip 42 also retrieves the gradation pattern data from the memory chip 44 based on a printing command from an action control unit 161 (to be described later) of the thermal printer 16, and outputs the gradation pattern data and the control signal to the driver IC 41.

Figure 3:
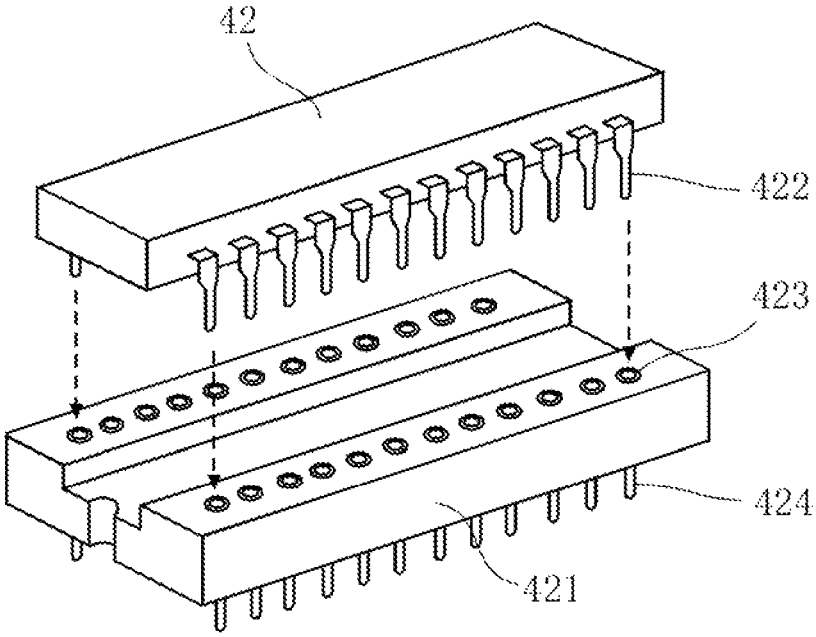
FIG. 3 is a perspective view showing a control chip and an IC socket.

The control chip 42 is implemented on the circuit board 22 via an IC socket 421. The IC socket 421 is directly mounted on the circuit board 22, so as to removably support the control chip 42. As shown in FIG. 3, the IC socket 421 includes a plurality of signal terminals 424 and a plurality of terminal insertion holes 423. The number of the signal terminals 424 is the same as that of the signal terminals 422 of the control chip 42. The terminal insertion holes 423 are each electrically connected to the respective signal terminal 424.

The quartz oscillator 43 generates a clock signal of 30 to 40 MHz for example, and provides a reference clock signal to the control chip 42. The clock signal serves to establish synchronization when data to be printed ("print data") is outputted to the driver IC 41.

Figure 16:
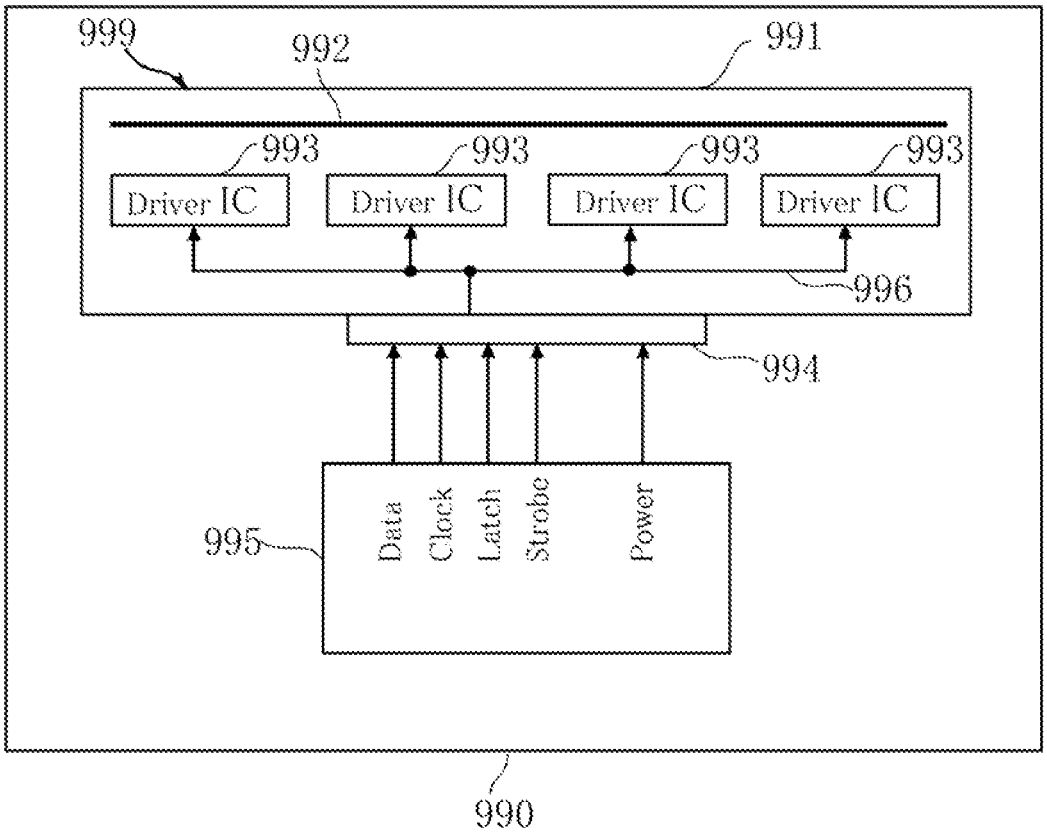
FIG. 16 is a block diagram of an example of a thermal printer including a conventional thermal print head.

Between the driver IC 41 and the control chip 42, the signal line 67 is provided. The signal line 67 constitutes a data signal line, a clock signal line, a latch signal line and a strobe signal line. In other words, the signal line 67 constitutes a signal line similar to the respective signal line 996 provided between the connector 994 and the driver IC 993 of the conventional thermal print head 999 (FIG. 16), between the control chip 42 and the driver IC 41.

The memory chip 44 stores the gradation pattern data converted by the control chip 42 from the image data. The storage and retrieval of the gradation pattern data in and from the memory chip 44 is controlled by the control chip 42. The memory chip 44 is, as the control chip 42, implemented on the circuit board 22 via the IC socket 441.

The connector 64 serves for electrical connection between the thermal print head 11 and the thermal printer 16. In this embodiment, a power supply line 162 and a signal line 163 are connected to the connector 64. The power supply line 162 serves to supply power to the thermal print head 11. The signal line 163 is a signal line formed in accordance with the Inter-Integrated Circuit (I2C) (hereinafter, "I2C signal line 163"), which enables serial communication of data.

The I2C signal line 163 includes the data signal line through which the data signal is transferred, and the clock signal line through which the clock signal synchronized with the data signal (different from the clock signal generated by the quartz oscillator 43). The I2C signal line 163 is capable of serially transfer the data based on a predetermined data format, at a transfer rate of, for instance, 3.4 Mbps. In this embodiment, the image data is transferred through the I2C signal line 163, from the action control unit 161 of the thermal printer 16 to the thermal print head 11. Since the I2C signal line 163 is capable of transferring the data based on a predetermined data format, the data based on a command can also be transferred. For example, a command for start the printing is transferred from the action control unit 161 of the thermal printer 16 to the control chip 42.

The thermal printer 16 includes the thermal print head 11, and also the action control unit 161, a motor control unit 164, and a printing mechanism 165. The action control unit 161 serves to control various actions according to inputs by a user through an operating unit (not shown). The action control unit 161 can, for example, transfer the image data inputted from outside of the thermal printer 16, to the thermal print head 11, and control the motor control unit 164 for executing the printing action. The action control unit 161 can also detect running out of the thermosensitive paper and announce abnormality of the apparatus.

The printing mechanism 165 of the thermal printer 16 includes, though not shown, a platen roller that presses the thermosensitive paper against the thermal print head 11, a feed roller and a takeup roller of the thermosensitive paper, and a plurality of driving motors that drives these rollers. The driving motors are driven under the control of the action control unit 161. In the case where the thermal printer 16 executes the thermal transfer printing on the ink ribbon, the printing mechanism 165 also includes a feed roller and a takeup roller of the ink ribbon, and a driving motor that drives these rollers.

Figure 5:
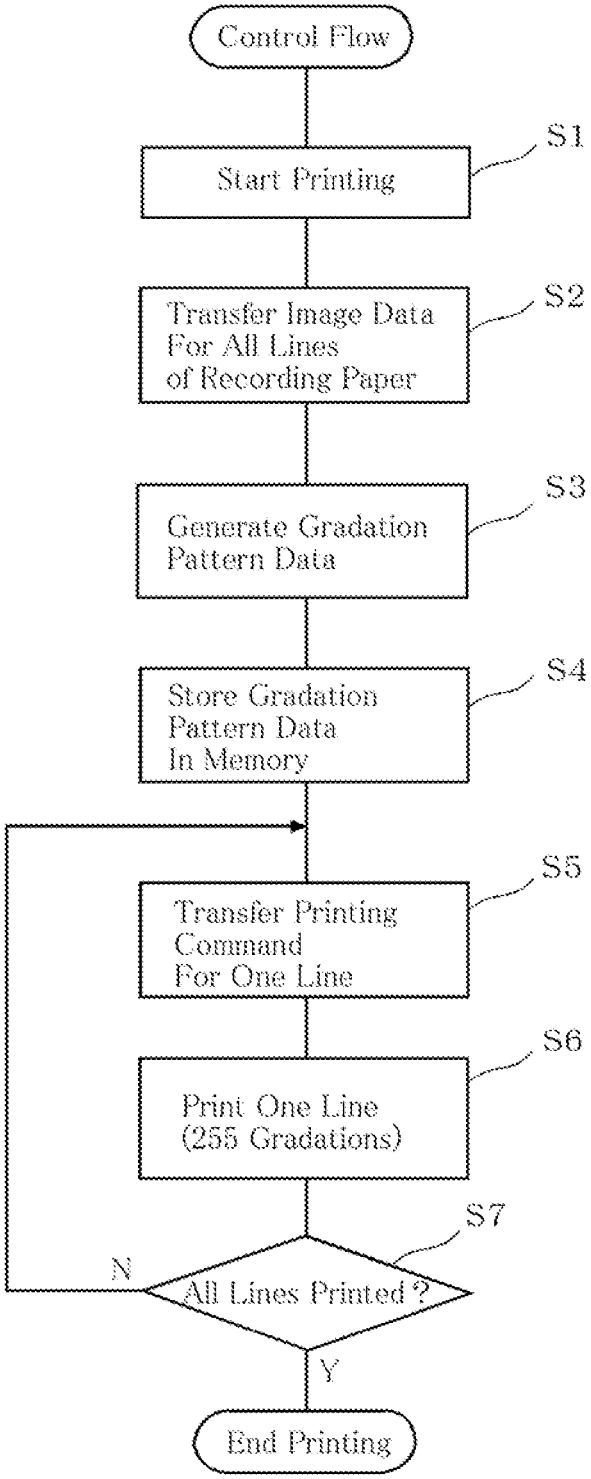
FIG. 5 is a flowchart showing controlling steps of the control chip.
Figure 6:
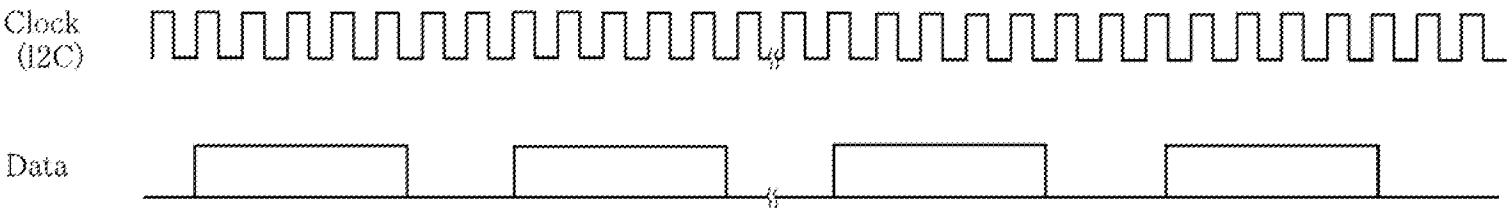
FIG. 6 is a timing chart of data transfer in accordance with the I2C.
Figure 7:
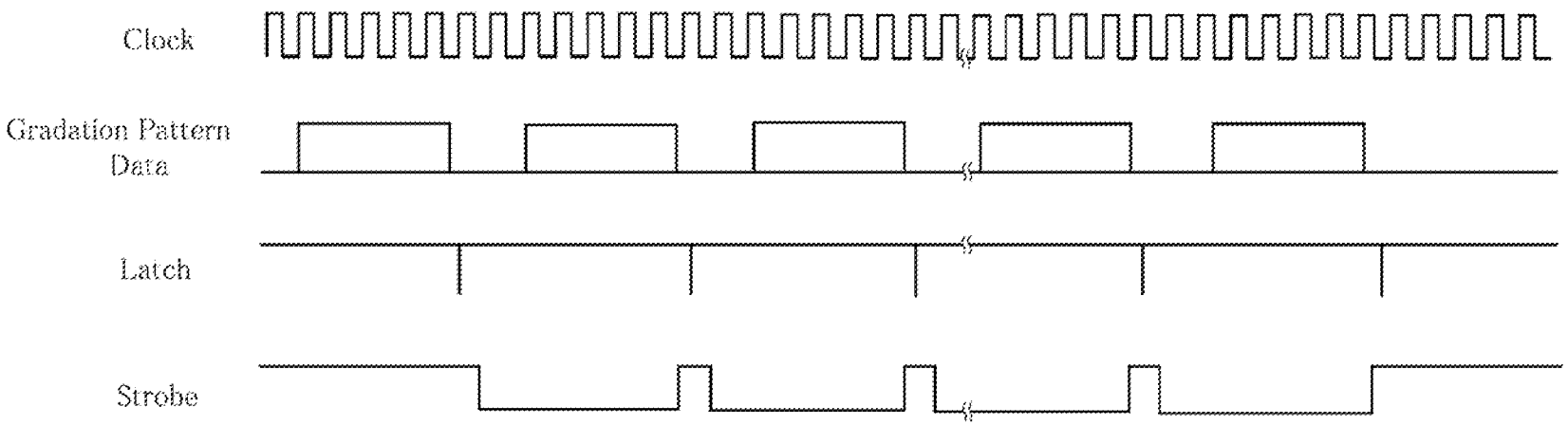
FIG. 7 is a timing chart of data transfer through a signal line.

Operation of the thermal print head 11 will now be described, referring to the flowchart shown in FIG. 5 and the timing chart shown in FIGS. 6 and 7. The flowchart of FIG. 5 primarily represents the controlling action of the control chip 42, but also includes some actions of the thermal printer 16.

When the thermal printer 16 is powered on, power is supplied to the thermal print head 11. Then when a printing action is started by, for example, manipulation through an operating unit which is not shown (S1), the image data is transferred from the action control unit 161 of the thermal printer 16 to the control chip 42 (S2). The image data contains the data of all the lines to be printed on the recording paper. In this embodiment, as stated above, the action control unit 161 of the thermal printer 16 and the thermal print head 11 are connected via the I2C signal line 163 based on the I2C specification. Accordingly, the image data is transferred at a high printing speed (for example, 3.4 Mbps) in synchronization with the predetermined clock signal, as shown in FIG. 6.

The control chip 42 executes the thermal history control upon receipt of the image data transferred from the thermal printer 16, and generates the gradation pattern data corresponding to, for example, 256 gradations (S3). The control chip 42 then sequentially stores the generated gradation pattern data in the memory chip 44 (S4). Thus, the data stored in the memory chip 44 is made up as the gradation pattern data subjected to the thermal history control.

Then a printing command for printing one line is transferred from the thermal printer 16 to the control chip 42 (S5), and the printing process for that one line is executed (S6). In this case, the control chip 42 retrieves the gradation pattern data from the memory chip 44, and outputs the gradation pattern data to the driver IC 41 through the data signal line included in the signal line 67. To be more detailed, the data for the same number of printing actions as the number of gradations of the image is outputted to the driver IC 41. For example, in the case where the number of gradations is 256, the data for printing 255 times per line (except for the gradation "0 (=white)") is transferred from the control chip 42 to the driver IC 41.

First, the gradation pattern data containing the data representing the dots of the gradation "1" and higher is inputted to a shift register (not shown) in the driver IC 41. Then as shown in FIG. 7, the gradation pattern data, inputted to the shift register at the timing that the latch signal enters the low level from the high level, is retained by the latch signal which is not shown. Then power is supplied to the minute portion of the heating resistor 30 to be heated, determined based on the gradation pattern data, in a period where the strobe signal enters the low level. Thus, the heating resistor 30 is selectively heated, and the data corresponding to the dots of the gradation "1" and higher is printed on the recording paper.

The subsequent gradation pattern data containing the data corresponding to the dots of the gradation "2" and higher is transferred to the shift register, in the period where the power is supplied to the heating resistor 30 for printing the dots of the gradation "1" and higher. Then the same process as above is executed, so that the data corresponding to the dots of the gradation "2" and higher is printed. In this case, the dots of the gradation "2" and higher are printed over the dots of the gradation "1", which have been printed in the first printing process. Such data transfer and printing action are repeated up to the gradation pattern data corresponding to the dots of the gradation "255 (=black)". With respect to the dots of the gradation "0 (=white)", such printing process is not executed while the gradation pattern data corresponding to the gradation "1" to "255" is printed, and the region on the recording paper corresponding to the dots that have remained unprinted during the printing process from the gradation "1" to the gradation "255" resultantly represents the white portion corresponding to the gradation "0".

The control chip 42 then decides whether all the lines of the recording paper have been printed (S7). In the negative case (S7: NO), the process returns to the step S5 and the printing command for printing the next line is transferred. In the case where it is decided at the step S7 that all the lines have been printed (S7: YES), the printing action is finished.

The thermal print head 11 and the thermal printer 16 provide the following advantageous effects.

In this embodiment, the control chip 42 and the memory chip 44 are mounted on the thermal print head 11. Such structure allows transferring the gradation pattern data, a conversion of the image data, and the control signal such as the clock signal, from the control chip 42 to the driver IC 41 through the signal line 67. Accordingly, the gradation pattern data and the clock signal can be transferred to the driver IC 41 at a higher speed, compared with the conventional way that the gradation pattern data and the clock signal are transferred through the signal line connecting the thermal printer 990 and the thermal print head 999. Consequently, the printing speed can be significantly increased, without suffering data deficiency and impact of the signal radiation.

The action control unit 161 of the thermal printer 16 and the thermal print head 11 are connected via the I2C signal line 163 formed in accordance with the I2C specification, which is widely applicable. Such configuration facilitates the connection, for example, between the thermal print head 11 and the thermal printer 16, and expands the applicability of the thermal print head 11.

In this embodiment, also, the control chip 42 and the memory chip 44 are mounted on the circuit board 22 via the IC socket 421, 441. In the case, for example, where the heating resistor 30 of the thermal print head 11 deteriorates after years of use, it would be appropriate to replace the thermal print head 11 as a whole. In this case, the original control chip 42 can be continuously utilized with the new thermal print head, by removing it from the IC socket 421 and mounting it on the IC socket of the new thermal print head. Thus, employing the IC socket 421 leads to reduction in cost. Likewise, the memory chip 44, which is also mounted on the IC socket 441, can also contribute to reducing the cost.

The thermal print head 11 and the thermal printer 16 according to this embodiment are also applicable in such case where both image data and character data (or 2 gradation data such as a barcode) are to be printed on a single recording paper 70.

Figure 8:
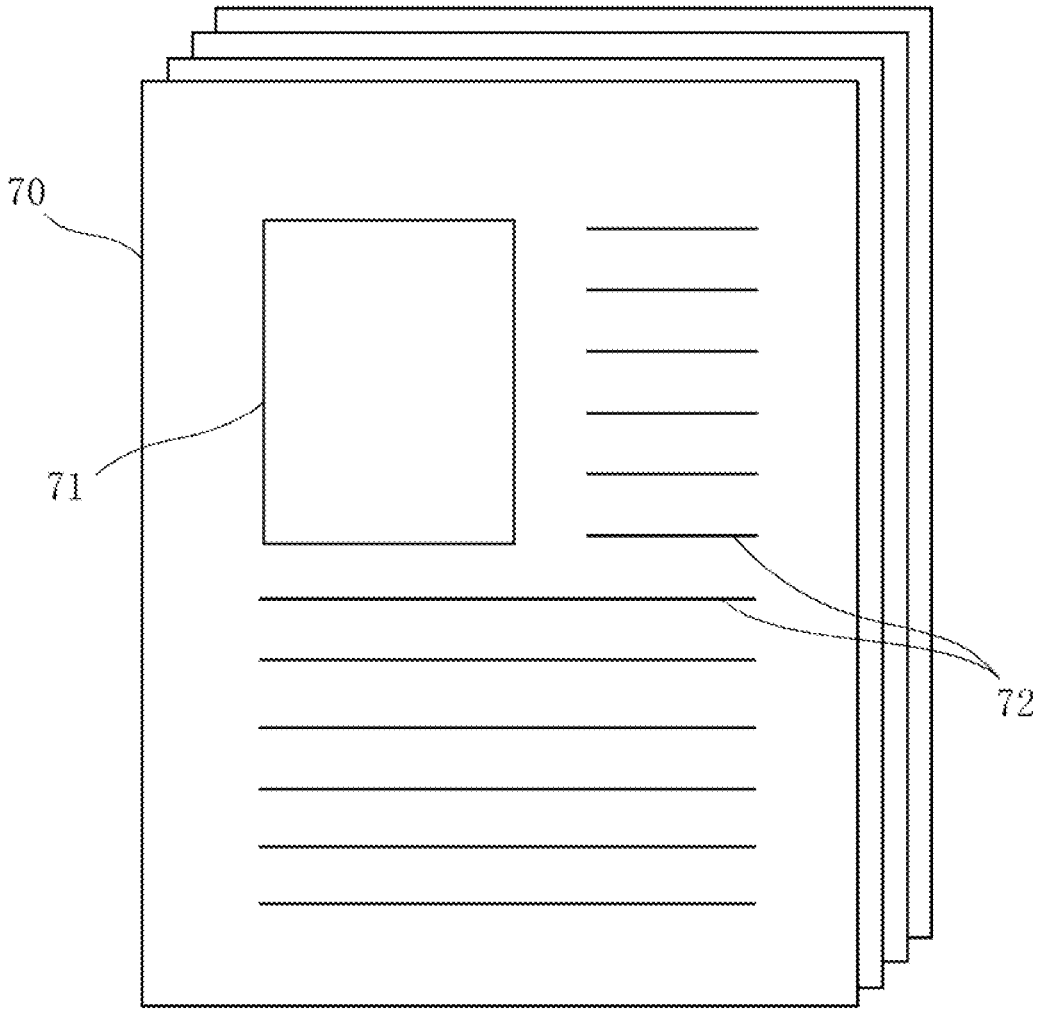
FIG. 8 is a drawing showing an example of recording papers on which both image data and character data are to be printed.

Such case will be described hereunder with reference to a plurality of recording papers 70, on which an image region 71 where the image data is to be printed and a character region 72 where the character data is to be printed are both defined, for example as shown in FIG. 8. In the case where both the image data and the character data are to be printed, the action control unit 161 of the thermal printer 16 collectively transfers the image data and the character data to the control chip 42 of the thermal print head 11. To be more detailed, the action control unit 161 transfers, upon receipt of the data to be printed on the recording paper 70 from outside, the image data and the character data collectively, to the control chip 42 through the I2C signal line 163.

The control chip 42 generates the gradation pattern data from the image data transferred from the action control unit 161, and stores the gradation pattern data in the memory chip 44. The control chip 42 also stores the character data in the memory chip 44. At this moment, the control chip 42 stores position information of the image region 71 and the character region 72, together with the foregoing data.

Once the printing command is transferred from the action control unit 161 to the control chip 42, the printing process for the first one line is executed. Here, in the case where both the image data and the character data are included in the first line (uppermost line) as shown on the recording paper 70 of FIG. 8, the control chip 42 retrieves the gradation pattern data, corresponding to the image data for the first line in the image region 71, from the memory chip 44. The control chip 42 also retrieves the character data for the first line in the character region 72. The control chip 42 outputs those data to the driver IC 41, and in the case, for example, where the gradation pattern data represents 256 gradations, the printing process is executed 255 times as described above. On the other hand, with respect to the character data, the printing process is not executed for the data "0 (=white)", but executed 255 times for the data "255 (=black)".

Through such steps, the image data and the character data for the first line of the image region 71 and the character region 72 are respectively printed. Thereafter the gradation pattern data and the character data for each line are sequentially outputted, from the second line to the final line, to the driver IC 41, so that the printing is executed on the entire region of the recording paper 70.

To print the image data and the character data on the second sheet of the recording paper 70, the control chip 42 compares the image data and the character data to be printed on the second recording paper 70, transferred from the action control unit 161, with the image data and the character data for the first recording paper 70. In the case, for example, where the image data is the same, the image data (gradation pattern data) already stored in the memory chip 44 is retrieved, for reutilization for the printing process on the second recording paper 70. Also, in the case where only a portion of the character data (for example, date, address, and the like) is different, the character data corresponding to the common portion is retrieved from the memory chip 44 for reutilization. Then only the character data corresponding to the different portion is newly stored in the memory chip 44, for retrieval when executing the printing process. With respect to the third and subsequent sheets of the recording paper 70, the printing process is executed in the same way.

On the recording paper 70 on which the printing is executed by the thermal printer 16, the layout of the image region 71 and the character region 72 is often fixed or patternized. Accordingly, reutilizing the common portion of the image data and the character data as above allows skipping the generation of the gradation pattern data of the common portion and storage thereof in the memory chip 44. Such arrangement therefore contributes to increasing the printing speed and simplifying the printing process. This advantage can be prominently enjoyed with the image data, since the image data contains an enormous data amount.

Further, the thermal printer 16 may be incorporated, for example, in a label printing machine that prints logistic labels. The label printing machine is capable of printing a plurality of types of labels. The label printing machine is designed so as to automatically replace the recording papers according to different types of labels. Employing the thermal printer 16 according to this embodiment contributes to reducing a total printing time, as described hereunder.

Figure 9:
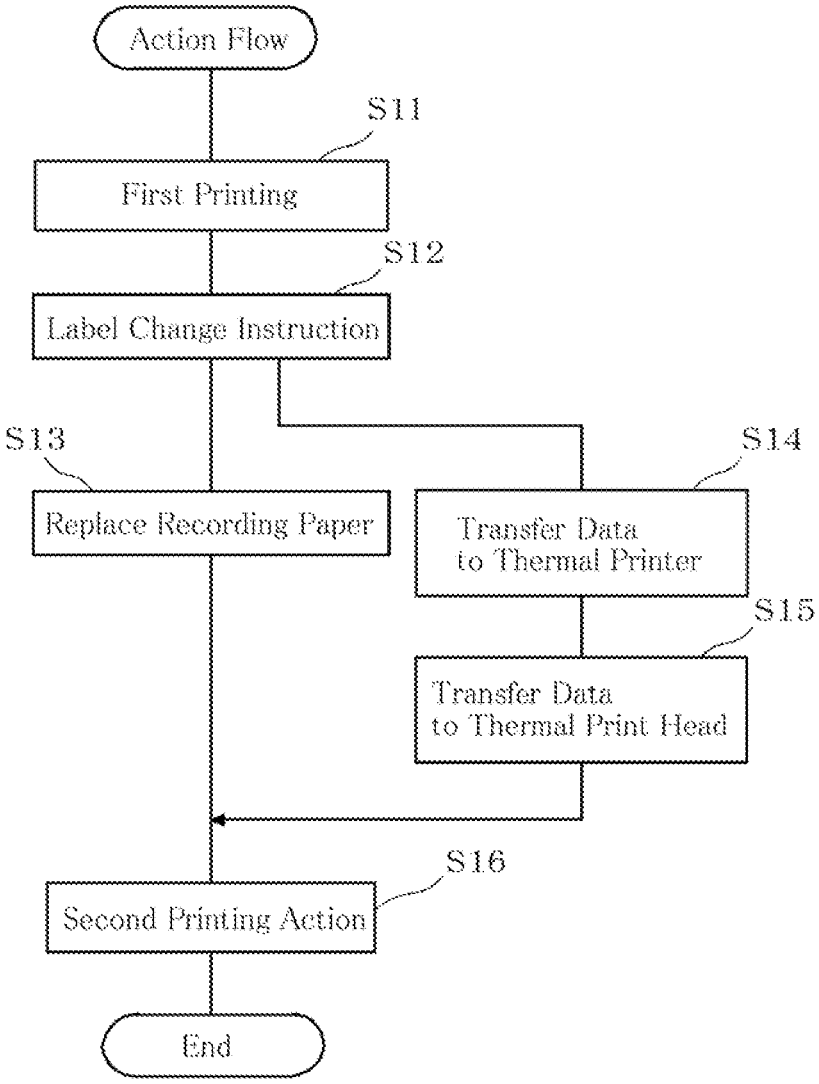
FIG. 9 is a flowchart showing operation of a label printing machine in which the thermal printer shown in FIG. 2 is incorporated.

FIG. 9 is a flowchart showing an example of the printing action executed by the label printing machine. By the label printing machine, for example a first printing action for a predetermined label is executed (S11). Once an instruction to replace the label to be printed is inputted (S12), the label printing machine automatically replaces the recording paper according to such instruction, with the one to be used for printing the next label (S13).

At this moment, in parallel with the replacing action (S13), the printing data necessary for printing the next label is transferred from the label printing machine to the thermal printer 16 (S14). In the thermal printer 16 the printing data is transferred to the thermal print head 11, and stored in the memory chip 44 (S15). Upon completion of the replacement of the recording paper, a second printing action for the next label is started (S16).

In the case where the thermal printer 16 is incorporated in the label printing machine, the replacement of the recording paper, the data transfer to the thermal print head 11, and the data processing in the thermal print head 11 are executed at the same time. Thus, since the printing of the next label is immediately started when the next recording paper is set, waste of time between the printing actions can be minimized, which contributes to reducing the total printing time.

FIGS. 10 to 16 depict other embodiments of the present invention. In these drawings, the constituents same as or similar to those of the foregoing embodiment are given the same numeral.

Figure 10:
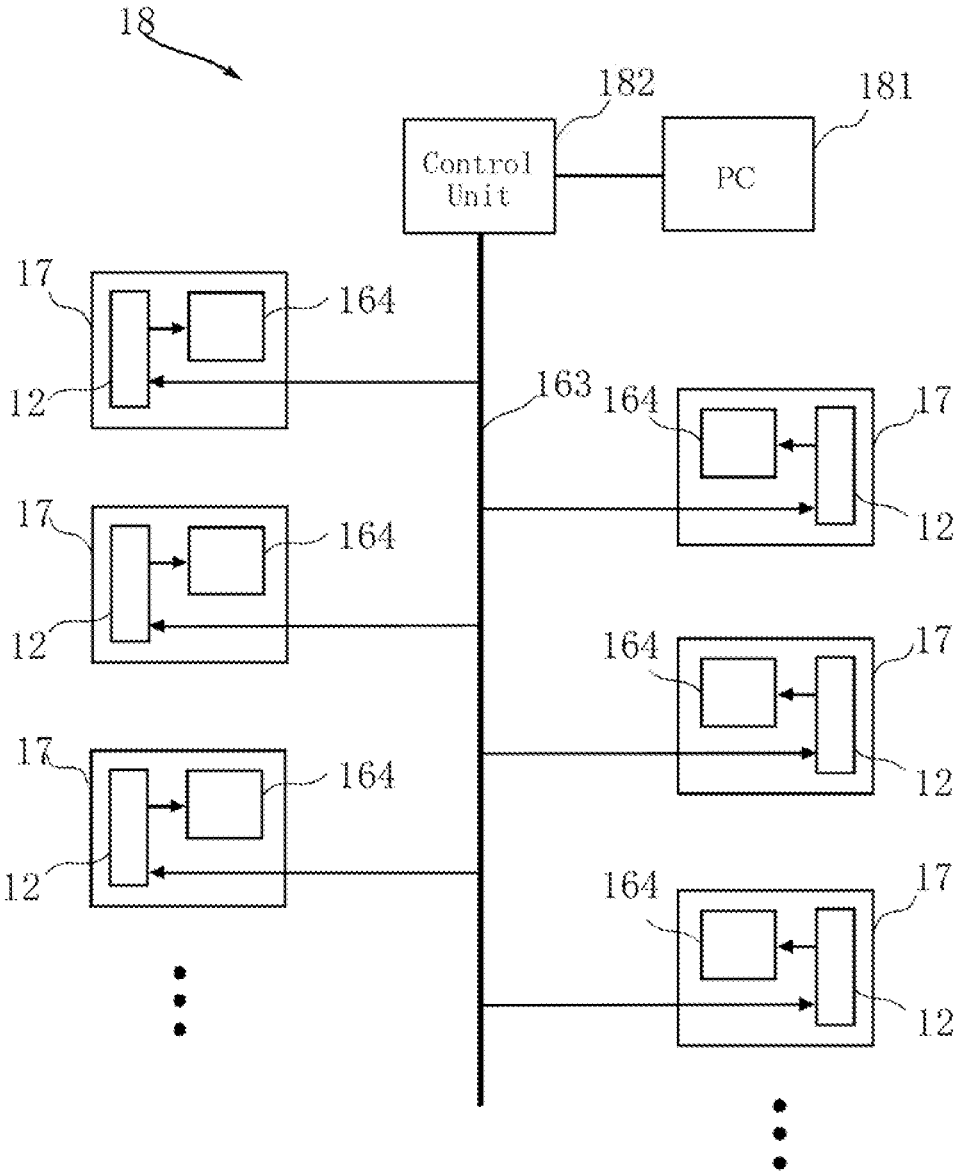
FIG. 10 is a block diagram of a printer system constituted of a plurality of thermal printers each including a thermal print head according to a second embodiment of the present invention.

FIG. 10 is a block diagram of a printer system constituted of a plurality of thermal printers each including a thermal print head according to a second embodiment of the present invention. In the printer system 18, the plurality of thermal printers 17 is connected to the control unit 182 through the I2C signal line 163, so as to make data communication.

To be more detailed, the printer system 18 includes, as shown in FIG. 10, a control unit 182 connected to a personal computer 181 for example, and the plurality of thermal printers 17 connected to the control unit 182 in a bus configuration through the I2C signal line 163. In the printer system 18, for example the control unit 182 may serve as the master device, and the plurality of thermal printers 17 as the slave device.

The control unit 182 includes for example a microcomputer, and integrally controls the printing action of the thermal printers 17 connected thereto through the I2C signal line 163. The control unit 182 includes an integral action control unit (not shown), which corresponds to the action control unit 161 of the thermal printer 16 shown in FIG. 2.

Figure 11:
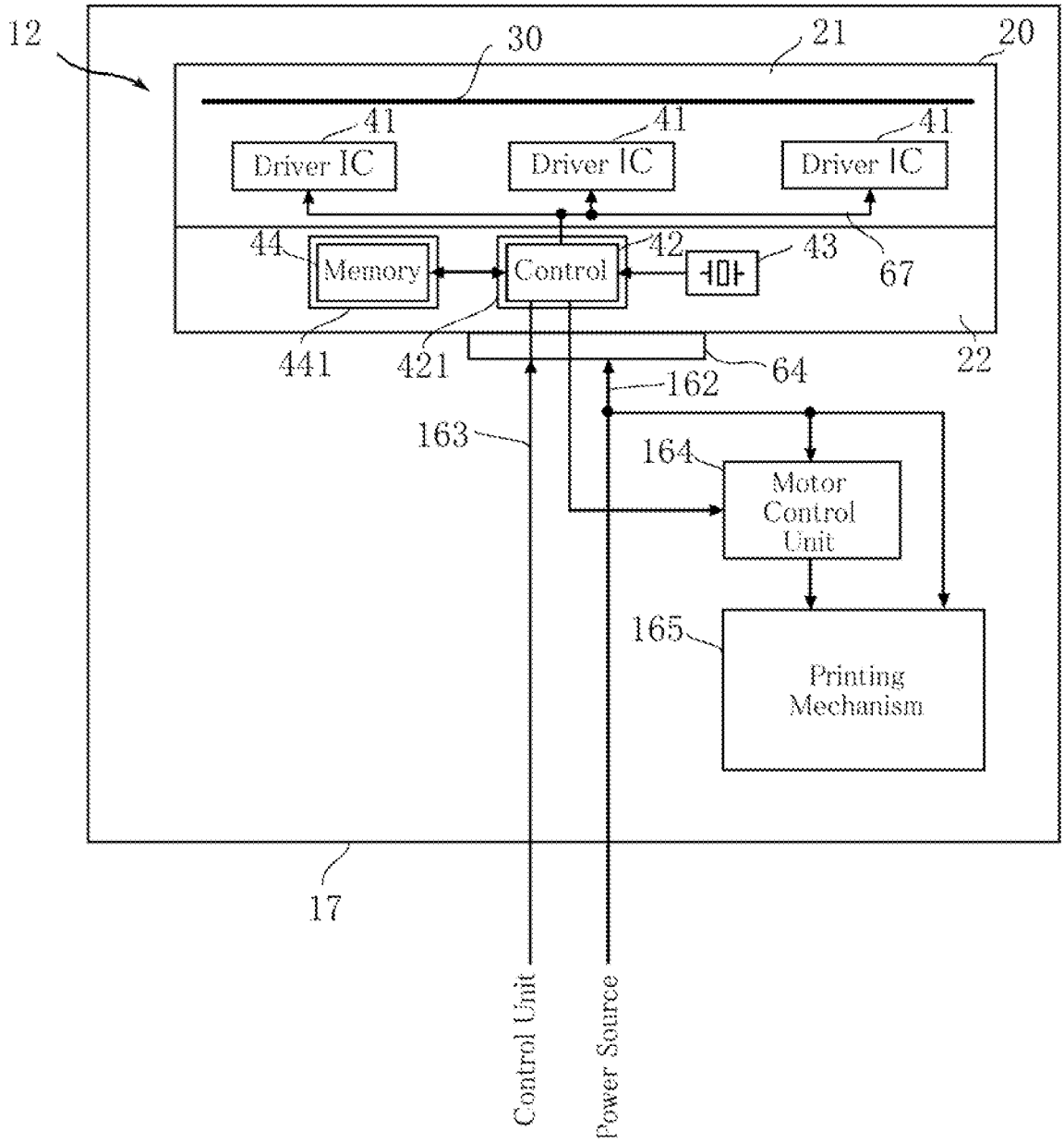
FIG. 11 is a block diagram of the thermal printer employed in the printer system shown in FIG. 10.

The thermal printer 17 includes a thermal print head 12 as shown in FIG. 11. The thermal print head 12 has generally the same structure as that of the thermal print head 11. The thermal printer 17 is without the action control unit 161 shown in FIG. 2. In the thermal printer 17, the I2C signal line 163 from the control unit 182 is directly connected to the control chip 42 of the thermal print head 12 via the connector 64 or another connector which are not shown. To the control chip 42, the motor control unit 164 and a control unit (not shown) are connected, which is the difference from the thermal print head 11.

Thus, in the printer system 18, the control unit 182 transmits the data to be printed to the respective thermal printers 17 through the I2C signal line 163. The control unit 182 also transmits the motor control signal for controlling the motor control unit 164 in a form of a command signal, to thereby control the printing action of the respective thermal printers 17.

In the communication according to the I2C specification, the control unit 182 and the plurality of thermal printers 17 can be operated under the relationship of the master device and the slave devices, as stated above. For example, various data such as image data and specific command signal can be transmitted in a predetermined data format, from the master device to the slave device by designating the address. In the case, for example, where a user wants to output an image picked up by a scanner (not shown) to one of the thermal printers 17 through the personal computer 181, the user can operate the personal computer 181 so as to transmit the image data that ahs been picked up to the control unit 182. The control unit 182 transmits the image data received from the personal computer 181 to the thermal printer 17 selected by the user, through the I2C signal line 163. The selected thermal printer 17 stores the transmitted image data directly in the memory chip 44 of the thermal print head 12.

Then the control unit 182 transmits the printing command to the selected thermal printer 17 through the I2C signal line 163. The control chip 42 of the thermal print head 12 transmits, upon receipt of the printing command, the motor control signal to the motor control unit 164. Further, the control chip 42 outputs the image data and the control signal (clock signal, latch signal, and strobe signal) to the driver IC 41, to thereby start the printing action. In this case, the control signal (clock signal, latch signal, and strobe signal) is outputted to the driver IC 41 through the signal line 67, and therefore high-speed printing can be executed.

Constituting thus the printer system 18 by means of the I2C signal line 163 allows integrally controlling the printing action of the plurality of thermal printers 17 with a single control unit 182. Also, an enormous amount of data can be transmitted to the thermal print head 12 of the respective thermal printers 17 directly and at a high speed, through the I2C signal line 163. Accordingly, the respective thermal printers 17 can execute high-speed printing despite that the data contains enormous image data. Further, the exclusion of the action control unit 161 from the thermal printers 17 contributes to simplifying the internal configuration.

Naturally, the thermal printer 16 (including the action control unit 161) shown in FIG. 2 may be connected to the control unit 182 through the I2C signal line 163, in place of the thermal printer 17 shown in FIG. 11. Alternatively, the thermal printer 16 and the thermal printer 17 may be mixedly connected to the control unit 182, in the printer system 18.

Figure 12:
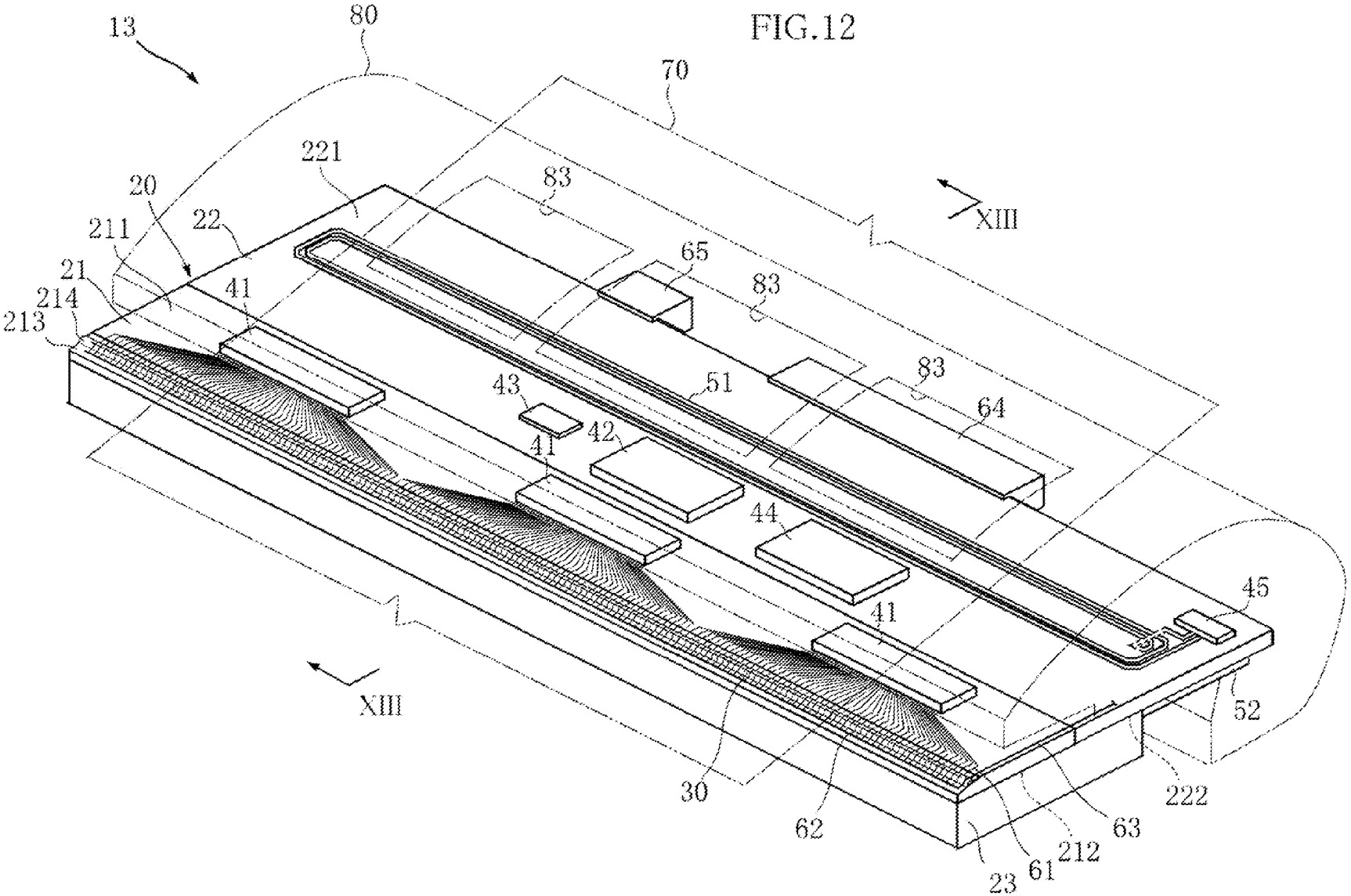
FIG. 12 is a perspective view showing a thermal print head according to a third embodiment of the present invention.
Figure 13:
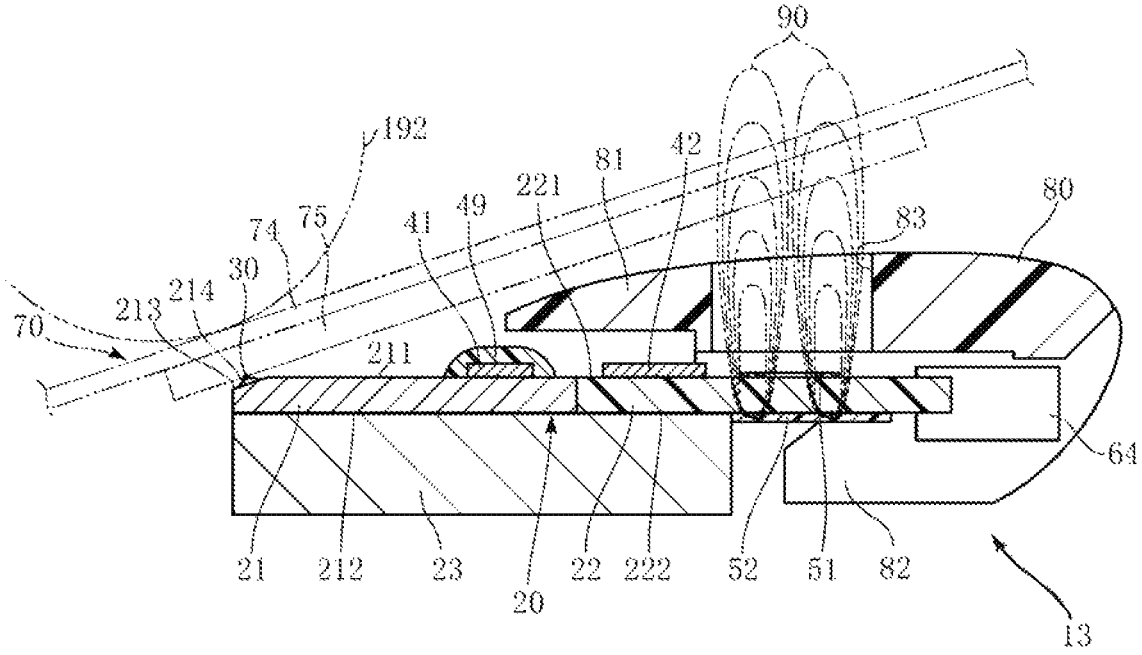
FIG. 13 is a cross-sectional view taken along a line XIII-XIII in FIG. 12.

FIGS. 12 and 13 illustrate a thermal print head according to a third embodiment of the present invention. The thermal print head 13 according to this embodiment is different from that of the foregoing embodiments in including a coil antenna 51, a magnetic sheet 52, a driver IC 45, a connector 65, and a cover 80. The thermal print head 13 can be incorporated for example in a Radio Frequency IDentification (RFID) tag printer through the connector 64, 65 as will be subsequently described, for executing the printing on an RFID tag sheet 70, corresponding to the recording paper 70, and data transmission/reception to and from the RFID tag sheet 70. Here, an encapsulating resin 49 shown in FIG. 13 is omitted in FIG. 12.

The RFID tag sheet, an example of the recording paper 70 for the thermal print head 13 will hereunder be described. The recording paper 70 is constituted as the RFID tag sheet, including for example a base paper 74 and a plurality of RFID tags 75 arranged thereon. The RFID tags 75 each include a memory, a target-side coil antenna, a printing sheet, and an adhesive sheet (all not shown), and are employed as a tag for luggage management at an airport, for example. The memory electronically stores identification data, such as the identification data for handling the luggage. The target-side coil antenna serves for data transmission/reception to and from the thermal print head 13 by wireless communication. The printing sheet is employed for printing a letter, symbol, barcode and the like corresponding to the identification data, and is made of a resin sheet or paper strip containing a thermosensitive coloring particle. The adhesive sheet is used to stick the RFID tag 75 to the luggage. For the data transmission/reception by wireless communication with the RFID tag 75, for example a frequency of 13.56 MHz is assigned by the Radio Law. The wireless communication in this frequency band is made according to what is known as electromagnetic induction. To execute the printing on the recording paper 70 thus configured and the data transmission/reception with the RFID tag 75, the thermal print head 13 is configured as described hereunder.

The front face 211 of the heating function unit 21 includes a slanted portion 213 located close to an edge of a side thereof. Because of the presence of the slanted portion 213, the RFID tag sheet, acting as the recording paper 70, is placed with an inclination with respect to the thermal print head 13, as shown in FIG. 13.

On the slanted portion 213, the partial glaze 214 is provided. The heating resistor 30 is located on the partial glaze 214. To effectively conduct the heat from the plurality of heating resistors 30 to the recording paper 70, for example a platen roller 192 may be employed for pressing the recording paper 70 against the heating resistor 30.

The driver IC 41 is covered with the encapsulating resin 49, for protection from an impact and electromagnetic shielding.

The coil antenna 51 and the driver IC 45 constitute the data transmitter/receiver according to the present invention, and is located on the front face 221 of the circuit board 22. The coil antenna 51 is constituted of Cu for example, and formed through depositing a Cu layer on the front face 221 and patterning the Cu layer by etching or the like. When a current is supplied to the coil antenna 51, an electromagnetic field 90 is generated as shown in FIG. 13, according to the direction and magnitude of the current. In this embodiment, the driver IC 45 is located outside the coil antenna 51 as shown in FIG. 12. In the wiring connecting the coil antenna 51 and the driver IC 45, a path extending from inside the coil antenna 51 to the driver IC 45 is insulated from the coil antenna 51 via an insulating layer (not shown). Otherwise, a through hole may be formed to thereby secure such path on the back face 222 of the substrate 22. Providing the path on the back face 222 is advantageous for enhancing the effect of the electromagnetic field 90 to the object.

The magnetic sheet 52 serves to suppress the electromagnetic field 90 generated by the coil antenna 51 from unduly expanding downward according to the orientation of FIG. 13. The magnetic sheet 52 may be a resin sheet containing for example ferrite powder serving as a magnetic material, and is provided on the back face 222 of the circuit board 22 in this embodiment. The magnetic sheet 52 has relatively high magnetic permeability but suffers relatively small electrical loss. Accordingly, the electromagnetic field 90 selectively passes through the magnetic sheet 52, and undesired heating in the magnetic sheet 52 can be suppressed. Examples of such magnetic sheet 52 include Flexield (registered trademark) manufactured by TDK Corporation.

As is apparent from FIG. 13, in this embodiment the heat dissipater 23 is deviated to the left in the sub scanning direction from the coil antenna 51, in other words located so as not to overlap with the coil antenna 51 when viewed thicknesswise of the heating function unit 21 and the circuit board 22.

The cover 80 covers the whole of the control chip 42, the quartz oscillator 43, and the memory chip 44, and a portion of the driver IC 41, and is constituted of a conductive resin containing a mixture of a black resin and carbon graphite. The cover 80 includes an upper portion 81 and a lower portion 82. The upper portion 81 and the lower portion 82 hold the circuit board 22 therebetween. In other words, the cover 80 is attached to the circuit board 22. As shown in FIGS. 12 and 13, the cover 80 includes a plurality of openings 83. In this embodiment, the openings 83 are aligned in the main scanning direction. The dimension of the openings 83 in the main scanning direction is smaller than a width (dimension in main scanning direction) of the recording paper 70.

Figure 14:
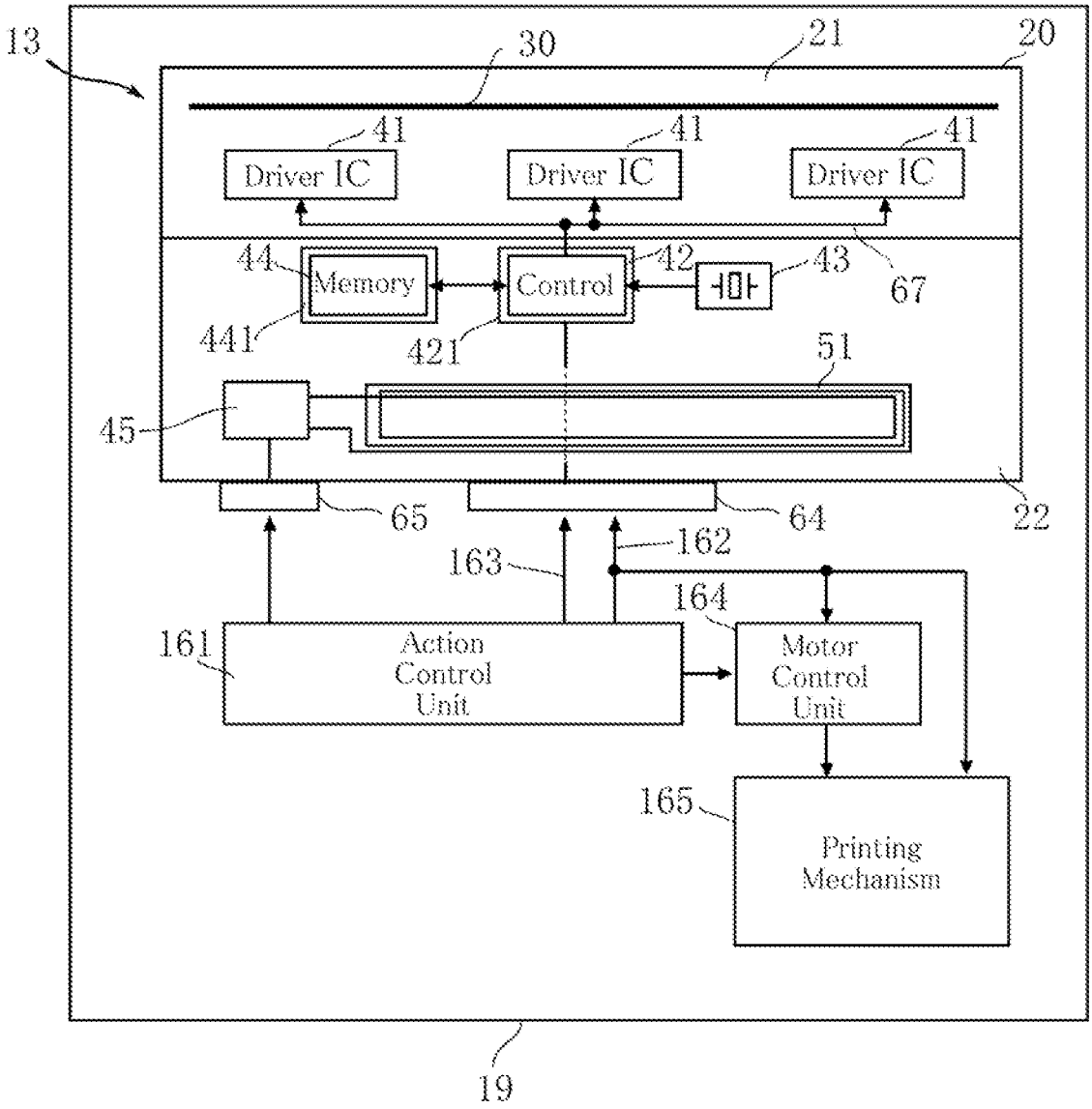
FIG. 14 is a block diagram of an RFID tag printer including the thermal print head according to the third embodiment of the present invention.

FIG. 14 is a block diagram of the RFID tag printer including the thermal print head 13. The RFID tag printer 19 includes the thermal print head 13, the action control unit 161, the motor control unit 164, and the printing mechanism 165. To the driver IC 45, the identification data is transmitted from the action control unit 161 via the connector 65. The driver IC 45 includes a circuit formed therein that controls the generation of the electromagnetic field 90 by the coil antenna 51, according to the identification data. The driver IC 45 adjusts the electromagnetic field 90 to the foregoing frequency of 13.56 MHz. The driver IC 45 may also have a processing function for receiving the identification data recorded on the recording paper 70, in addition to the transmission of the identification data. The receiving function can also be executed by wireless communication, according to the electromagnetic induction method utilizing the electromagnetic field 90.

Hereunder, description will be given on the printing process on the recording paper 70 and the data transmission/reception with the recording paper 70 executed by the RFID tag printer 19.

First, the identification data corresponding to the respective RFID tags 75 is transmitted from an external personal computer (not shown) to the action control unit 161. Then the recording paper 70 is delivered according to the instruction from the action control unit 161. During the delivery of the recording paper 70, tracking of the RFID tag 75 is executed with an approximation sensor or the like.

Figure 15:
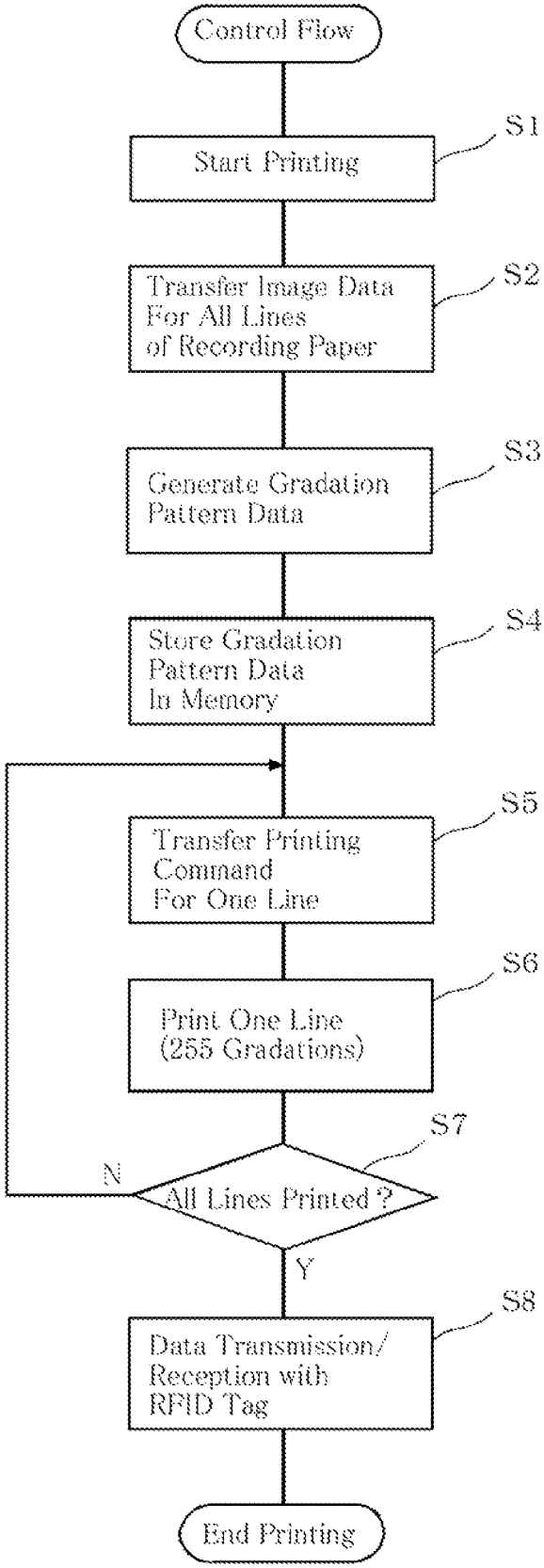
FIG. 15 is a flowchart showing controlling steps of the RFID tag printer shown in FIG. 14.

When the RFID tag 75 reaches an upper position of the thermal print head 13, the action control unit 161 transmits instructions to the thermal print head 13 so as to execute the printing process S1 to S7 of the flowchart shown in FIG. 15. The process S1 to S7 is the same as that described referring to FIG. 5. Through such printing process, the letter, symbol, barcode and the like corresponding to the identification data are printed on the RFID tag 75.

When the printing process is completed, the action control unit 161 transmits an instruction to the thermal print head 13, so as to start the data transmission/reception between the thermal print head 13 and the RFID tag 75 (S8). By this step the electromagnetic field 90 is generated by the coil antenna 51, so that the wireless communication based on the electromagnetic induction is made with the RFID tag 75. From the electromagnetic field 90, power supply for activating the RFID tag 75 and transmission of the identification data are simultaneously executed to the RFID tag 75. Accordingly, the identification data corresponding to the respective RFID tag 75 is recorded on the relevant RFID tag 75. In the case where the thermal print head 13 or the RFID tag printer 19 has the data receiving function, the identification data recorded on the RFID tag 75 is received through the coil antenna 51 of the thermal print head 13, immediately after the transmission of the identification data. In this case, for example, the action control unit 161 can check whether the identification data recorded on the RFID tag 75 is correct. Here, the data transmission/reception (S8) may be executed after the completion of the steps S1 to S7, or in parallel therewith.

Thereafter, the RFID tag 75 is discharged out of the RFID tag printer 19. The RFID tag 75, printed and bearing the identification data recorded thereon, is removed by the user from the base paper and stuck to an object of management such as a luggage. The luggage with the RFID tag 75 stuck thereto can be easily controlled using an RFID tag reader or the like, at the departing airport, in the aircraft, the arriving airport, and so forth.

According to this embodiment, both the printing and the data transmission can be executed by utilizing the thermal print head 13 alone. Such configuration eliminates the need to employ, for example, a coil antenna for the purpose of data transmission/reception, in addition to the thermal print head 13. This enables reducing the dimensions of the RFID tag printer 19.

Providing the coil antenna 51 on the circuit board 22 allows reducing the dimensions of the thermal print head 13 itself. This is advantageous for reducing the dimensions of the RFID tag printer 19. Also, the structure according to this embodiment prevents interference between the coil antenna 51 and the platen roller 192.

Also, providing the coil antenna 51 in the thermal print head 13 allows locating the coil antenna 51 at a position sufficiently close to the RFID tag 75. Here, the thermal print head 13 is configured to execute the printing on the RFID tag 75, the print target, in contact therewith. Accordingly, locating the coil antenna 51 in the thermal print head 13 facilitates locating the coil antenna 51 close to the RFID tag 75. Locating the coil antenna 51 closer to the RFID tag 75 can make the RFID tag 75 pass through a region in the electromagnetic field 90 where the magnetic field is more intense. Such configuration allows minimizing a failure that the magnetic field intensity acting on the RFID tag 75 falls below a minimum working intensity of magnetic field specified for the RFID tag 75. Also, higher intensity of the magnetic field is advantageous for increasing the reliability and speed of the data transmission/reception based on the electromagnetic induction. In particular, locating the coil antenna 51 on the front face 221 of the circuit board 22 enables the coil antenna 51 to directly confront the RFID tag 75.

The magnetic sheet 52 suppresses the electromagnetic field 90 from unduly expanding downward according to the orientation of FIG. 13. Such structure can increase the magnetic field intensity of the portion of the electromagnetic field 90 extending upward in FIG. 13, and hence contributes to further increasing the reliability and speed of the data transmission/reception with the RFID tag 75.

Forming the opening 83 on the cover 80 allows preventing the electromagnetic field 90 from being unduly weakened by the cover 80. This also contributes to increasing the reliability and speed of the data transmission/reception with the RFID tag 75. Making the dimension of the opening 83 in the main scanning direction smaller than the width (dimension in main scanning direction) of the recording paper 70 minimizes the risk that the recording paper 70 is accidentally caught by the opening 83.

The thermal print head, the thermal printer, and the printer system according to the present invention are not limited to the foregoing embodiments. Specific structure of the constituents of the thermal print head, the thermal printer, and the printer system according to the present invention may be modified in various manners.

For example, although the I2C specification is adopted for transmission of the image data between the thermal print head 11 and the thermal printer 16 in the embodiments, for example a Low Voltage Differential Signaling (LVDS) or another serial communication method that is relatively inexpensive and fast may be adopted instead. The LVDS provides the advantage of suppressing power consumption in the high-speed communication by utilizing a relatively low voltage, and also suppressing a noise because of utilizing the differential signal.

Further, although the embodiment exemplifies the case where the thermal print head prints the image data in monochrome, the thermal print head according to the present invention may also be utilized for printing the image data in colors. More particularly, the thermal print head according to the present invention can be suitably employed for printing the gradations of yellow, magenta, and cyan. Alternatively, the thermal print head according to the present invention may be utilized for two-color printing, where the heating resistor is heated at different temperatures to thereby print two colors (such as red and black, or blue and black).

The invention claimed is:

1. A thermal print head comprising:

a heating resistor that generates heat for forming an image in lines sequentially on a print target, the lines each extending in a primary scanning direction;

a driver that controls power supply to the heating resistor;

a storage unit that stores print data inputted from outside; and a main controller that causes a transfer action and a printing action to be alternately repeated with respect to a same line of the lines, wherein the transfer action includes retrieving print data from the storage unit and transferring the retrieved print data to the driver, and the printing action includes causing the driver to retain the transferred print data and supplying power to portions of the heating resistor selected in accordance with the print data retained by the driver, so as to conduct printing.

2. The thermal print head according to claim 1, comprising:

a substrate on which the heating resistor is formed; and an intermediate conductor mounted on the substrate;

wherein the controller comprises a control chip removably supported by the intermediate conductor.

3. The thermal print head according to claim 2, wherein the substrate is provided with a wiring pattern including a signal line for the print data disposed between the control chip and the driver, the wiring pattern further including a signal line for a control signal to supply power to the heating resistor.

4. The thermal print head according to claim 2, wherein the substrate is connected with a signal line for transferring a signal to be inputted to the control chip, and the signal line is an I2C signal line for executing serial transfer of the signal.

5. The thermal print head according to claim 2, further comprising an additional intermediate conductor mounted on the substrate, wherein the storage unit comprises a memory chip removably supported by the additional intermediate conductor.

6. The thermal print head according to claim 1, further comprising a data transmitter/receiver that executes data transmission/reception by wireless communication with respect to the print target, wherein the print target is provided with a target-side coil antenna and a memory.

7. The thermal print head according to claim 6, wherein the data transmitter/receiver includes an apparatus-side coil antenna.

8. The thermal print head according to claim 7, wherein the data transmitter/receiver further includes a driver IC for the apparatus-side coil antenna.

9. The thermal print head according to claim 7, wherein the data transmitter/receiver is capable of executing data transmission/reception to and from the print target, which is constituted as a Radio Frequency IDentification (RFID) tag.

10. The thermal print head according to claim 7, further comprising a substrate and a plurality of heating resistors aligned on the substrate, wherein the apparatus-side coil antenna is mounted on the substrate.

11. The thermal print head according to claim 10, wherein the apparatus-side coil antenna is located on a face of the substrate on which the plurality of heating resistors are provided.

12. The thermal print head according to claim 7, further comprising a magnetic sheet containing a magnetic material.

13. The thermal print head according to claim 12, wherein the magnetic material is ferrite.

14. The thermal print head according to claim 13, wherein the magnetic sheet is located on a face of the substrate opposite to a face on which the apparatus-side coil antenna is provided.

15. The thermal print head according to claim 8, further comprising a cover that covers the driver IC, wherein the cover is formed with an opening through which the apparatus-side coil antenna is exposed as viewed in a thicknesswise direction of the substrate.

16. The thermal print head according to claim 15, wherein in a main scanning direction, the opening is smaller in size than the print target.

17. A thermal printer with a wireless communication function, comprising the thermal print head according to claim 6, so that printing on the print target and data transmission/reception to and from the print target are executed.

18. A thermal printer comprising:

the thermal print head according to claim 1;

an action controller that transmits the print data to the thermal print head and causes the thermal print head to execute printing; and a signal line for serially transferring the print data from the action controller to the main controller.

19. A printer system comprising:

a plurality of thermal printers each including the thermal print head according to claim 1;

a control unit that transmits the print data to a designated thermal printer among the plurality of thermal printers and causes the designated thermal printer to execute printing; and a signal line that connects the control unit and the plurality of thermal printers in a bus configuration, for serial transfer of the print data.

20. The thermal print head according to claim 1, further comprising a substrate supporting the heating resistor, the driver, the storage unit and the main controller.

21. The thermal print head according to claim 20, wherein the substrate includes a heating function unit and a circuit board, the heating function unit and the circuit board being made of different materials.

22. The thermal print head according to claim 20, further comprising a heat dissipater stuck to the heating function unit and the circuit board.

23. The thermal print head according to claim 22, wherein the heat dissipater covers an entire back face of the heating function unit and covers at least a part of a back face of the circuit board.

* * * * *